US008083653B2

(12) United States Patent
Hetrick

(10) Patent No.: US 8,083,653 B2
(45) Date of Patent: Dec. 27, 2011

(54) EXERCISE DEVICE HAVING A DOOR ANCHOR

(75) Inventor: Randal Hetrick, San Francisco, CA (US)

(73) Assignee: Fitness Anywhere, LLC, San Francisco, CA (US)

( * ) Notice: Subject to any disclaimer, the term of this patent is extended or adjusted under 35 U.S.C. 154(b) by 0 days.

(21) Appl. No.: 11/948,860

(22) Filed: Nov. 30, 2007

(65) Prior Publication Data

US 2009/0075787 A1 Mar. 19, 2009

Related U.S. Application Data

(60) Provisional application No. 60/973,111, filed on Sep. 17, 2007.

(51) Int. Cl.
*A63B 21/002* (2006.01)

(52) U.S. Cl. ..... 482/91; 482/96; 482/904

(58) Field of Classification Search ..... 482/91, 482/114, 120–133, 139, 904, 92, 95, 96, 482/907

See application file for complete search history.

(56) References Cited

U.S. PATENT DOCUMENTS

| | | | | | |
|---|---|---|---|---|---|
| 223,799 | A | * | 1/1880 | Butler | 482/139 |
| 2,233,725 | A | | 3/1941 | Begin | 211/119 |
| 2,716,027 | A | | 8/1955 | Gehri | 482/131 |
| 3,369,809 | A | | 2/1968 | Morrill, Jr. | 482/91 |
| 3,411,776 | A | | 11/1968 | Holkesvick et al. | 482/120 |
| 3,519,269 | A | * | 7/1970 | Howlett et al. | 482/120 |
| 3,532,189 | A | | 10/1970 | Wade | 188/65.3 |
| 3,608,900 | A | | 9/1971 | Welch | 482/120 |
| 3,677,543 | A | | 7/1972 | Richardson | 482/129 |
| 3,739,772 | A | * | 6/1973 | Ennis | 602/4 |
| 3,752,474 | A | | 8/1973 | Macabet et al. | 482/131 |
| 3,910,573 | A | | 10/1975 | Jamba | 482/91 |
| 3,979,114 | A | | 9/1976 | Codina | 482/131 |
| 4,059,265 | A | * | 11/1977 | Wieder et al. | 482/125 |
| 4,060,240 | A | | 11/1977 | Dunston | 482/131 |
| 4,073,490 | A | * | 2/1978 | Feather | 482/129 |
| 4,220,328 | A | * | 9/1980 | Crush, Jr. | 482/92 |
| 4,337,938 | A | * | 7/1982 | Rodriguez | 482/74 |
| 4,343,466 | A | | 8/1982 | Evans | 482/120 |
| 4,441,707 | A | | 4/1984 | Bosch | 482/131 |
| 4,463,948 | A | * | 8/1984 | Mohr | 482/129 |
| 4,477,073 | A | * | 10/1984 | Koch et al. | 482/91 |
| 4,522,391 | A | | 6/1985 | Randall | 482/40 |

(Continued)

FOREIGN PATENT DOCUMENTS

AU 727828 1/2001

(Continued)

OTHER PUBLICATIONS

Hetrick, Randal, co-pending U.S. Appl. No. 11/296,196, filed Dec. 7, 2005.

(Continued)

*Primary Examiner* — Steve R Crow
*Assistant Examiner* — Daniel Roland
(74) *Attorney, Agent, or Firm* — Steven R. Vosen

(57) ABSTRACT

An exercise device having a door anchor is described. The anchor is fixed to a pair of elongated members each having a grip. The anchor stands off from the door by 1 to 18 inches before attaching to the elongated members. In one embodiment, the exercise device is sewn together. In another embodiment, a ring holds the various components together.

8 Claims, 11 Drawing Sheets

U.S. PATENT DOCUMENTS

| | | | | | |
|---|---|---|---|---|---|
| 4,544,155 | A | * | 10/1985 | Wallenbrock et al. | 482/129 |
| 4,560,160 | A | | 12/1985 | Smith | 482/120 |
| 4,685,671 | A | | 8/1987 | Hagerman et al. | 482/124 |
| 4,733,862 | A | | 3/1988 | Miller | 482/126 |
| 4,836,537 | A | | 6/1989 | Moreno | 482/139 |
| 4,909,505 | A | * | 3/1990 | Tee | 482/129 |
| 4,948,117 | A | * | 8/1990 | Burke | 482/55 |
| 5,100,129 | A | * | 3/1992 | Porter et al. | 482/129 |
| 5,176,602 | A | * | 1/1993 | Roberts | 482/131 |
| 5,209,712 | A | | 5/1993 | Ferri | 482/143 |
| 5,217,029 | A | | 6/1993 | Shields | 482/49 |
| 5,234,395 | A | | 8/1993 | Miller et al. | 482/118 |
| 5,254,065 | A | | 10/1993 | Pollack | 482/129 |
| 5,352,172 | A | | 10/1994 | Suzaki | 482/120 |
| 5,352,174 | A | | 10/1994 | Mason et al. | 482/129 |
| 5,399,137 | A | | 3/1995 | Kushner | 482/114 |
| 5,433,688 | A | | 7/1995 | Davies | 482/124 |
| 5,514,059 | A | * | 5/1996 | Romney | 482/124 |
| 5,518,486 | A | | 5/1996 | Sheeler | 482/131 |
| 5,556,369 | A | | 9/1996 | Roberts | 482/131 |
| 5,569,140 | A | | 10/1996 | Elliman | 482/140 |
| 5,571,064 | A | | 11/1996 | Holm | 482/129 |
| 5,624,360 | A | | 4/1997 | Wilkins | 482/129 |
| 5,653,668 | A | * | 8/1997 | Wilkinson | 482/124 |
| 5,766,118 | A | * | 6/1998 | Conner | 482/129 |
| 5,795,274 | A | | 8/1998 | Kasbohm | 482/115 |
| 5,800,322 | A | | 9/1998 | Block | 482/121 |
| 5,807,214 | A | | 9/1998 | Riazi | 482/129 |
| 5,842,961 | A | | 12/1998 | Davis | 482/139 |
| 5,852,988 | A | * | 12/1998 | Gish | 119/795 |
| 5,871,424 | A | * | 2/1999 | Conner | 482/129 |
| 5,910,073 | A | * | 6/1999 | Conner | 482/129 |
| 5,916,070 | A | | 6/1999 | Donohue | 482/74 |
| 5,967,947 | A | * | 10/1999 | Glover | 482/91 |
| 6,059,698 | A | * | 5/2000 | Mazor | 482/79 |
| 6,102,837 | A | | 8/2000 | Hubbard | 482/120 |
| 6,110,075 | A | * | 8/2000 | Woodruff | 482/47 |
| 6,113,564 | A | * | 9/2000 | McGuire | 602/32 |
| 6,245,001 | B1 | * | 6/2001 | Siaperas | 482/142 |
| 6,258,011 | B1 | | 7/2001 | Wolfe | 482/23 |
| 6,273,029 | B1 | * | 8/2001 | Gish | 119/792 |
| 6,322,483 | B1 | | 11/2001 | Rotella | 482/129 |
| 6,348,026 | B1 | | 2/2002 | Kuo | 482/126 |
| 6,450,929 | B1 | | 9/2002 | Markham | 482/124 |
| 6,500,103 | B2 | | 12/2002 | Porter | 482/121 |
| 6,662,753 | B1 | * | 12/2003 | Sporn | 119/797 |
| 6,726,606 | B2 | * | 4/2004 | Jacobsen | 482/121 |
| 6,835,169 | B2 | * | 12/2004 | Tamaribuchi | 482/139 |
| 6,908,418 | B2 | | 6/2005 | Saure | |
| 6,921,354 | B1 | | 7/2005 | Shifferaw | 482/91 |
| 7,044,896 | B2 | | 5/2006 | Hetrick | |
| 7,090,622 | B2 | | 8/2006 | Hetrick | |
| 7,125,371 | B2 | | 10/2006 | Henderson | 482/142 |
| 7,137,935 | B2 | * | 11/2006 | Clarke et al. | 482/123 |
| 7,291,099 | B1 | * | 11/2007 | Marczewski | 482/114 |
| 7,293,531 | B2 | * | 11/2007 | Young, III | 119/798 |
| 7,326,157 | B2 | * | 2/2008 | Wu | 482/126 |
| 7,343,647 | B1 | * | 3/2008 | Kinskey et al. | 24/3.13 |
| 7,438,674 | B2 | * | 10/2008 | Sjodin | 482/91 |
| 7,625,325 | B1 | * | 12/2009 | Yost | 482/129 |
| 2002/0022555 | A1 | | 2/2002 | Nesci | 482/92 |
| 2003/0045408 | A1 | * | 3/2003 | Seles | 482/121 |
| 2003/0078142 | A1 | * | 4/2003 | Jacobsen | 482/126 |
| 2003/0216220 | A1 | * | 11/2003 | Rota | 482/27 |
| 2004/0087420 | A1 | * | 5/2004 | Montesquieux | 482/129 |
| 2004/0116259 | A1 | * | 6/2004 | Rosiles | 482/121 |
| 2004/0204300 | A1 | | 10/2004 | Hetrick | |
| 2004/0204301 | A1 | * | 10/2004 | Hetrick | 482/91 |
| 2005/0085350 | A1 | * | 4/2005 | Shen | 482/91 |
| 2005/0113223 | A1 | * | 5/2005 | Dovner et al. | 482/121 |
| 2005/0170937 | A1 | * | 8/2005 | van Straaten | 482/124 |
| 2005/0233875 | A1 | * | 10/2005 | Clarke et al. | 482/123 |
| 2006/0081197 | A1 | * | 4/2006 | Kuykendall | 119/792 |
| 2006/0084556 | A1 | * | 4/2006 | Payne | 482/121 |
| 2006/0183609 | A1 | * | 8/2006 | Flynn | 482/124 |
| 2006/0264302 | A1 | * | 11/2006 | Sjodin | 482/91 |
| 2009/0075788 | A1 | * | 3/2009 | Hetrick | 482/91 |
| 2009/0075789 | A1 | * | 3/2009 | Hetrick | 482/91 |
| 2009/0075794 | A1 | * | 3/2009 | Hetrick | 482/139 |

FOREIGN PATENT DOCUMENTS

| | | | |
|---|---|---|---|
| DE | 19527241 | | 1/1997 |
| JP | 2003275341 | A | 9/2003 |
| WO | WO 2005/014119 | A1 | 2/2005 |

OTHER PUBLICATIONS

Hetrick, Randal, co-pending U.S. Appl. No. 11/419,320, filed May 19, 2006.

Hetrick, Randal, co-pending U.S. Appl. No. 11/557,050, filed Nov. 6, 2006.

Hetrick, Randal, co-pending U.S. Appl. No. 11/948,863, filed Nov. 30, 2007.

Hetrick, Randal, co-pending U.S. Appl. No. 11/948,868, filed Nov. 30, 2007.

Hetrick, Randal, co-pending U.S. Appl. No. 11/948,872, filed Nov. 30, 2007.

Hetrick, Randal, co-pending U.S. Appl. No. 11/948,875, filed Nov. 30, 2007.

Hetrick, Randal, co-pending U.S. Appl. No. 11/948,876, filed Nov. 30, 2007.

Bodybuilder's Discount Outlet, Tricep Rope (1), pp. 27-28, summer 1995 catalog.

Dosho Design, Inc., Jam Gym description, www.jamgym.com/jamGym.php, Jan. 6, 2003.

Jam Gym Manual, Dosho Design, Inc., downloaded from website (www.jamGym.com/jamGym.php), Jan. 6, 2003.

International Search Report—Nov. 21, 2008.

First Office Action of Corresponding Chinese Application No. 200880107519.2, dated Jun. 21, 2011, Hetrick.

Examination Report of Corresponding New Zealand Application No. 584644, dated Jun. 20, 2011, Hetrick.

Examination Report of Corresponding Singapore Application No. 201001149-2, dated Jul. 22, 2011, Hetrick.

* cited by examiner

EXERCISE DEVICE HAVING A DOOR ANCHOR

CROSS-REFERENCE TO RELATED APPLICATIONS

This application claims the benefit of U.S. Provisional Application No. 60/973,111 filed Sep. 17, 2007, the entire contents of which is hereby incorporated by reference herein and made part of this specification.

BACKGROUND OF THE INVENTION

The present invention generally relates to exercise devices, and in particular to an exercise device having an inelastic strap that is easily configurable for anchoring to a structure.

Resistance exercise devices allow a user to exercise by providing a resistance to the movement of a user's arms, legs, or torso. Thus, for example, such devices allow a user to exercise by working one muscle against another, or by working against the weight of the user, by providing a resistance to the movement of a user's arms, legs, or torso. Resistance exercise devices typically include either elastic bands or inelastic straps.

Resistance exercise devices having elastic bands typically restrict the motion of a user's arms and/or legs, or the motion between the user and a support structure. Elastic exercise devices typically have limited usefulness that result from their resistance characteristics, which depend on the length and elasticity of the elastic band. Due to differences in height, weight, or strength between different users, it may not be possible to use a device for a variety of exercises or for different users to use the device for the same exercise. Elastic resistance exercise devices typically provide resistance that is inconsistent and which increases with increasing displacement, and tend to snap back when released.

Resistance exercise devices having inelastic straps are typically attachable to a structure, such as, for example, a door. While devices having inelastic straps do not have many of the problems of those having elastic bands, they are generally usable for a limited number of exercises.

There is a need to provide a resistance exercise device that is capable of being used for a complete workout for any user, including adjustments that allow a wide range of stances and exercises, and that provides resistance to the user's motion in a form that is useful for exercising.

BRIEF SUMMARY OF THE INVENTION

The present invention overcomes the disadvantages of prior art by providing an exercise device that is easily configurable and mountable to a variety of structures. For example, certain embodiments described herein include a number of rings for connecting different exercise device components.

In certain embodiments, an exercise device for mounting between a door and a door jamb of a closed door is provided. The exercise device includes an anchor and a pair of adjustable length portions. The anchor has a first portion, an enlarged portion, and an elongate portion extending between the first portion and the enlarged portion. Each of the pair of adjustable length portions extends from a corresponding grip to the first portion. When the anchor is mounted to the closed door the elongated portion extends from a first side of the closed door to a second side of the closed door, the enlarged portion is not passable through the closed door, and the elongate portion extends away from the door by a distance.

In certain other embodiments, an adjustable, inelastic exercise device for mounting to a structure is provided. The device includes a first, second, and third elongated member. The first elongated member has a first length between a first grip and a first attachment position, and a first mechanism to adjust the first length. The second elongated member has a second length between a second grip and a second attachment position, and a second mechanism to adjust the second length. The third elongated member has a first end coupled to the first attachment position and the second attachment position, and a third length between the first end and a second end attachable to a door jamb. The third length is greater than 1 inch.

These features together with the various ancillary provisions and features which will become apparent to those skilled in the art from the following detailed description, are attained by the exercise device of the present invention, embodiments thereof being shown with reference to the accompanying drawings, by way of example only, wherein:

BRIEF DESCRIPTION OF THE SEVERAL VIEWS OF THE DRAWING

FIG. 5 is a perspective view, and FIG. 6 is sectional view 6-6;

FIG. 11A is a reverse combination crunch, FIG. 11B is a single leg L-squat, FIG. 11C is a gymnast dip, FIG. 11D is a kneeling combination crunch, FIG. 11E is a lying leg curl, FIG. 11F is a hip lift, FIG. 11G is a front shoulder raise, FIG. 11H is a crunch, and FIG. 11I is a triceps extension.

Reference symbols are used in the Figures to indicate certain components, aspects or features shown therein, with reference symbols common to more than one Figure indicating like components, aspects or features shown therein.

DETAILED DESCRIPTION

For purposes of contrasting various embodiments with the prior art, certain aspects and advantages of these embodiments are described where appropriate herein. Of course, it is to be understood that not necessarily all such aspects or advantages may be achieved in accordance with any particular embodiment. Modifications and variations can be made by one skilled in the art without departing from the sprit and scope of the invention including, but not limited to: the use of inelastic members, which are described herein as straps, that are round or have some other cross-sectional shape, and/or which are formed from two or more members joined together, as by stitching or with an adhesive; or the use of different mechanisms for adjusting the length of inelastic member that are known in the field including, but not limited to, buckles, hooks, or winding the inelastic member about a rigid element. Moreover, any one or more features of any embodiment may be combined with any one or more other features of any other embodiment, without departing from the scope of the invention.

Figure 1:
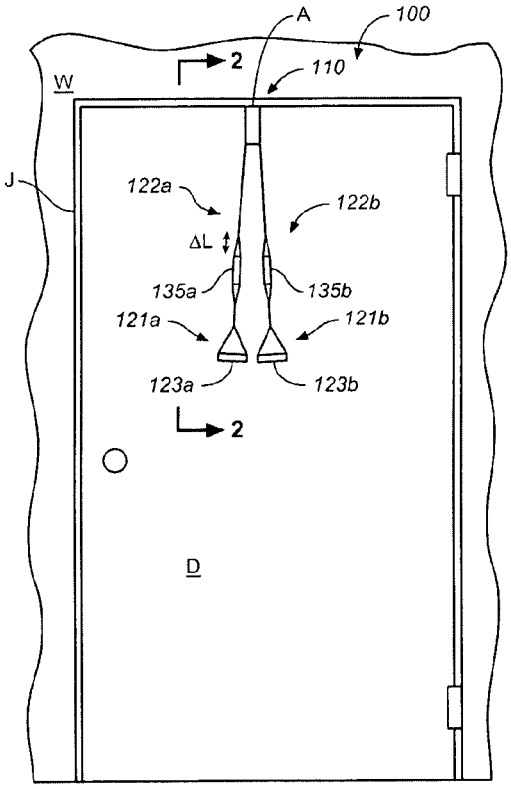
FIG. 1 is a schematic front view of a first embodiment of an exercise device as anchored between a door and door jamb.
Figure 2:
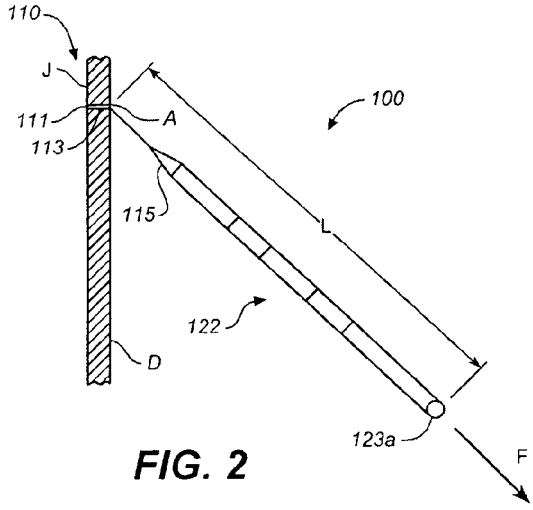
FIG. 2 is a partial schematic sectional view 2-2 of FIG. 1 showing the exercise device anchored between a door and door jamb.
Figure 3:
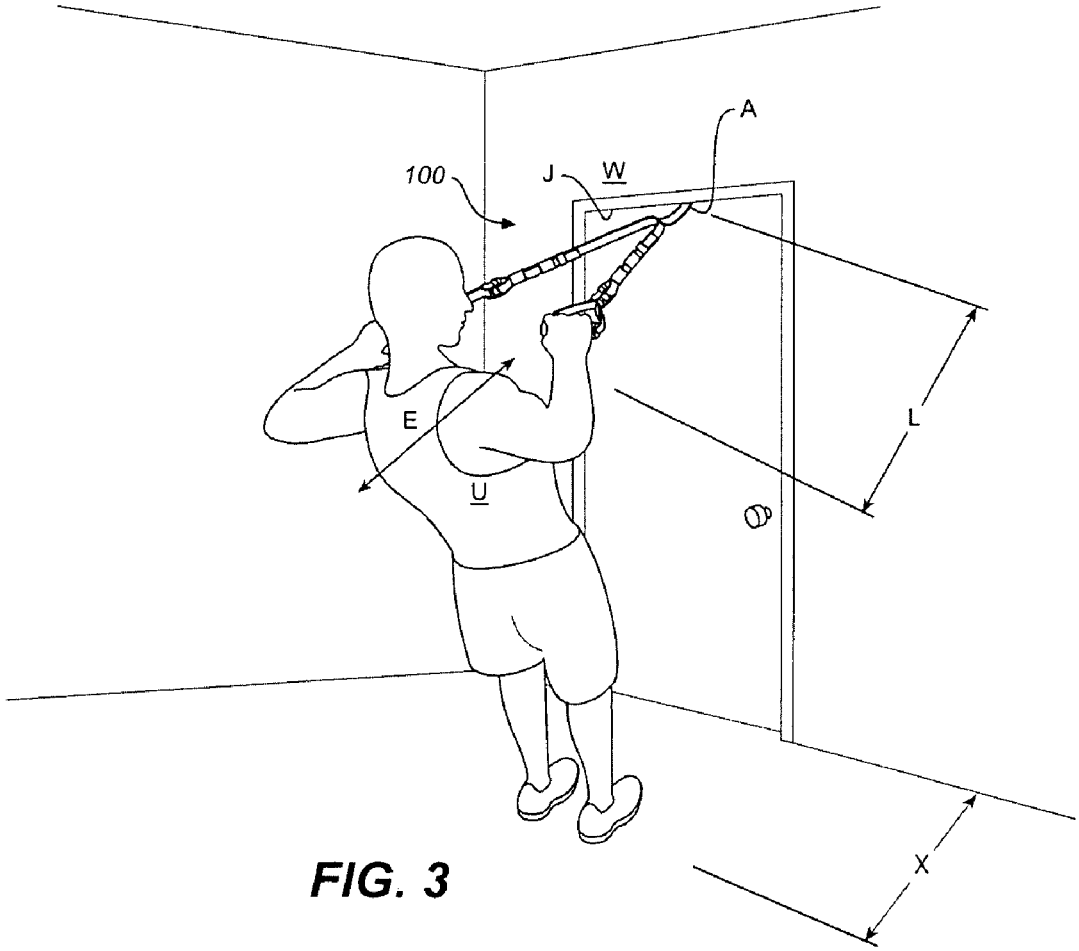
FIG. 3 is illustrative of a user performing a high row exercise with the exercise embodiment of FIG. 1.

Disclosed herein is an inelastic exercise device that is supported by, or that can be easily attached to, a supporting structure, and that allows a user to perform a large number of exercises by easily adjusting the length of the device and thereafter balancing the device as the user's weight is transferred to the device. Several of the features will now be illustrated with reference to FIGS. 1-3. FIG. 1 is a schematic front view of a first embodiment of exercise device 100 that is anchored at a point A between a door D and door jamb J. FIG. 2 is a partial sectional view 2-2 of FIG. 1 taken through door D and showing exercise device 100 in profile, and FIG. 3 is illustrative of a user U exercising with the exercise device of FIG. 1.

Exercise device 100 includes an anchor 110 and a pair of elongated members 122, indicated as a first elongated member 122*a* and a second elongated member 122*b*, on either side of the anchor, as shown schematically in FIGS. 1 and 2. Each of the pair of elongated members 122 has a corresponding lengthening mechanism 135, indicated as mechanism 135*a* and 135*b*. A pair of grips 123 is provided, with one positioned at each end 121 of each arm 122, specifically first arm 122*a* has a first grip 123*a*, and second arm 122*b* has a second grip 123*b*. Each arm 122 is substantially inelastic and flexible with an adjustable length L between a corresponding one of the pair of grips 123 and anchor 110. The length of each arm 122 is adjustable by use of the corresponding lengthening mechanisms 135, as indicated by double arrows ΔL.

As used herein, the noun "grip" encompasses any device that is interlockable with part of the human body, that is it can be connected in such a way that a person can transfer a force to the grip, preferably a force equal to some or all of the person's weight, and the verb "grip," when used herein, refers to the action of interlocking the device and a body part. When used in an exercise device, a grip is attached to other elements that permit the force to be transferred to another object, including but not limited to a stationary support, a device that can store or release energy, such as an elastic cord or a spring, or another body part. Grips include devices that can be surrounded by a body part, for example flexible loop or a hook, or that a body part can surround, for example an elongated member that can fit within the grasp of the hand. In this context, a member that can be gripped, or is grippable, is one that can surround a body part or can be surrounded by a body part, and has a size and configuration that permits the transfer of forces from the user to the grip. A "hand grip" is grip that is sized for grasping by the hand, a "foot grip" is grip that is sized for grasping a foot, and a "finger grip" is grip that is sized for grasping by one or more fingers.

Anchor 110 provides a support for elongated member 120 that permits some amount of movement. Specifically, the interaction of anchor 110 and elongated member 120 allows the elongated member to be positioned along on the anchor, and may also provide resistance to the movement of the elongated member along the anchor. Preferably the resistance is sufficient so that, under some circumstances, the support prevents movement of elongated member 120 along anchor 110, even where there is some mis-match of forces on the ends of the elongated member. In this way exercise device 100 may be used for a variety of exercises, by changing the length of elongated member 120, for example, and also provide an exercise device that can provide support for the user while exercising.

One type of support is referred to herein, without limitation, as a "frictional support." Anchors that provide frictional support include, but are not limited to, an element or portion of an element that can support elongated member 120 during exercising, and over which the elongated member can slide. Resistance to the movement of elongated member 120 over anchor 110 may be determined, in part, by the frictional resistance of the elongated member sliding over the anchor. In several embodiments of methods of using exercise device 100, elongated member 120 slides along anchor 110 while a user positions herself. During exercising, a slight mis-match in the pulling forces on the grips is matched by static friction of the frictional support, and the grips do not move while exercising. That is, the static friction between elongated member 120 and anchor 110 generated by the frictional support is sufficient to permit exercises in which elongated member 120 does not slide through anchor 110 while exercising. Means that provide frictional support include elements or portions of elements that form part of or which are attached to an anchor and which can support an elongated member (that may, for example, include grips) and which can allow the elongated member to slide along the supporting anchor and provide frictional resistance to the motion of the elongated member during exercising.

Anchor 110 is used to provide a fixed anchor point for exercise device 100 and to support a user's weight as it is applied to elongated members 122 as indicated by an arrow F in FIG. 2 and as shown in FIG. 3. As shown in FIG. 2, anchor 110 is adapted for positioning exercise device 100 in a door and providing support to elongated members 122 by having an enlarged portion 111, an elongated member 113 that can be strap or cord, and an attachment 115 for supporting the elongated members by the anchor. With enlarged portion 111 on the opposite side of door D from elongated members 122, anchor 110 supports the weight of a user as grips 123 are pulled. The length of each of elongated member 122 can be easily adjusted through the each lengthening mechanism 135. FIG. 2 shows arms 122 each having a length L.

In one embodiment, the length L is adjustable over a length that allows for a wide range of exercises. Thus, for example and without limitation, length L can be varied in length from approximately 3 feet to 6 feet. In another embodiment, elongated member 122 has a width of approximately 1.5".

When supported by a structure, such as door D (as shown, for example, in FIGS. 1-3) the inventive exercise device provides a pair of grips for a user to exercise against her weight according the user's position relative to the device, and provides for easily adjusting the length of the device. As described below, the inventive device can be used to exercise in any one of a large number of orientations according the selected adjustable length and according to where and how the user stands relative to the exercise device. In general, a user sets the exercise device to a desired length, positions herself on the ground near the exercise device, supports a portion of her body weight from the exercise device by her hands or feet, and exercises by moving her body with her weight supported by the ground and the exercise device. Examples of support on the ground and exercise device include, but are not limited to, standing on one or both legs, lying on the stomach or the back, kneeling, or by having the hands on the ground, and having the exercise device support ones weight by the hands or feet, as appropriate.

In an alternative embodiment (not shown), elongated members 122 do not include lengthening mechanisms 135. In this embodiment, elongated members 122 are thus substantially inelastic and have a fixed length L between the pair of grips 123.

With reference to FIG. 3, a user U is shown in one of the many exercise positions, in particular a high row exercise, gripping the pair of grips 123 with the user's hands and having the user's feet placed a horizontal distance X from anchor point A. When anchored to a door, it is preferred that anchor point A is on the inwards side of the door (that is, that the door open away from user U) so that jamb J can support the user's weight. The user U is shown leaning away from anchor point A and supporting a fraction of his or her weight through device 100. It is apparent that user U can vary the amount of supported weight, and thus the resistance of exercise device 100, by adjustment of his or her stance relative to anchor point A (distance X) and the length of arms 122 (length L). The user U of FIG. 3 performs a high row exercise by moving his body in a direction E towards and away from anchor point A. Note that other exercises are also possible with the user in this position by the user moving in other directions with the user's weight supported by the ground and exercise device 100.

Figure 4:
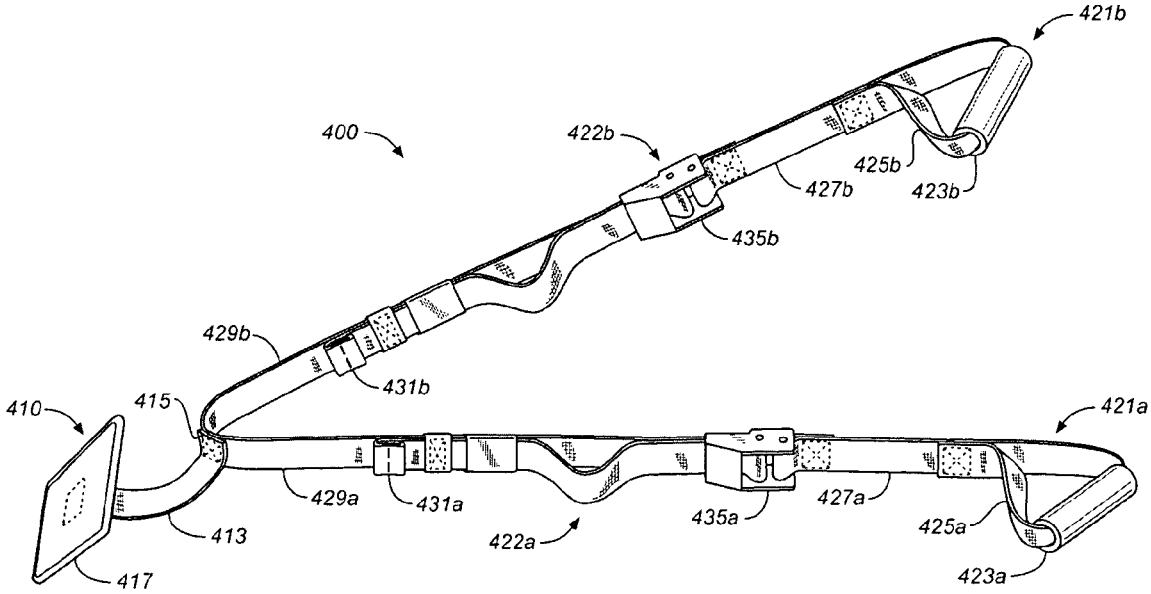
FIG. 4 is a perspective view of a second embodiment of an exercise device.

Several embodiments will now be described with reference to the drawings. These embodiments are meant to be illustrative and not limiting to the scope of the claims. FIGS. 4, 5, 6, 7, 8, 9A, and 9B are various views of a second embodiment of an exercise device 400. Referring first to FIG. 4, a perspective view of exercise device 400 is shown as including a first embodiment of an anchor 410 and a pair of elongated members 422. Exercise device 400, anchor 410, and elongated members 422 are generally similar to exercise device 100, anchor 110, and elongated members 122, respectively, except further detailed below. Where possible, similar elements are identified with identical reference numerals in FIGS. 1-9.

Anchor 410 includes an inelastic, flexible elongated member 413 having an enlarged first end 411 that is wider than the strap, and a second end at attachment 415. Anchor 410 supports each of a pair of elongated members 422, indicated as elongated members 422*a* and 422*b* at attachment 415. Each elongated members 422 has a respective end 421, shown as end 421*a* and 421*b*, each forming a loop 425, shown as loop 425*a* and 425*b*, to support one of a pair of grips 423, shown as grip 423*a* and 423*b*. Each elongated member 422 also includes a pair of lengthening devices 435, shown without limitation, as buckle 435*a* and 435*b*. In addition, each elongated member 422 includes a member 429, shown as members 429*a* and 429*b*, that is sewn to strap 414 at attachment 415.

Figure 5:
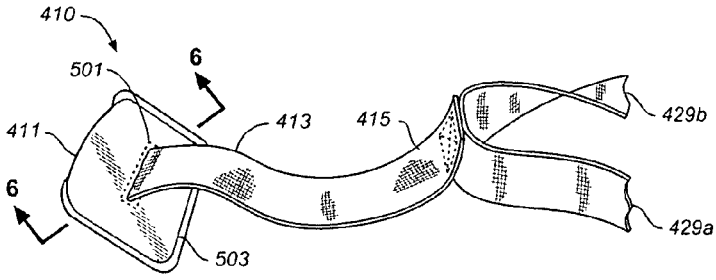
FIGS. 5 and 6 are views of a first embodiment of an anchor of the exercise device of FIG. 4, where
Figure 6:
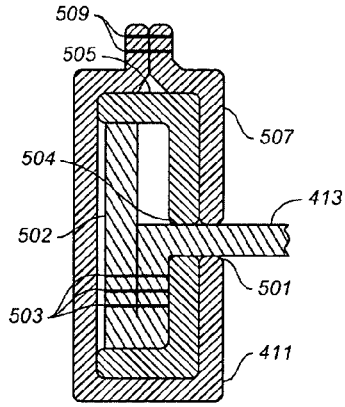
Figure 8:
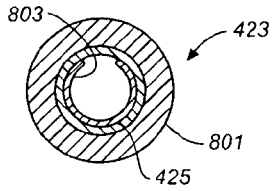
FIG. 8 is a sectional view 8-8 of FIG. 7 showing the hand grip.

FIGS. 4, 5 and 8 present several views of anchor 410, where FIG. 5 is a perspective view of the anchor and FIG. 6 is a sectional view 6-6 of the anchor. As noted previously, anchor 410 includes an inelastic, flexible elongated member 413. In one embodiment, the majority of lengths of anchor 410 and elongated members 422 are formed of materials that include, but are not limited, to straps of a webbing of a natural or synthetic material having strength sufficient to support the weight of a device user. Webbing materials include, but are not limited to, one or more of a nylon, polypropylene or other polymeric fibers. It is to be understood that a single length of flexible material can alternatively comprise two or more pieces that are stitched, glued, or otherwise attached to one another. In various embodiments, the length of elongated member 413 from first end 411 to attachment 415 is greater than 1 inch, greater than 2 inches, greater than 3 inches, greater than 4 inches, greater than 5 inches, greater than 6 inches, greater than 7 inches, greater than 8 inches, greater than 9 inches, greater than 10 inches, greater than 11 inches, greater than 12 inches, greater than 13 inches, greater than 14 inches, greater than 15 inches, greater than 16 inches, or greater than 17 inches. In certain other embodiments, the length of elongated member 413 from first end 411 to attachment 415 is from 1 to 18 inches, from 2 to 17 inches, from 3 to 16 inches, from 4 to 15 inches, from 5 to 14 inches, or from 6 to 13 inches. In another embodiment, the length of elongated member 413 from first end 411 to attachment 415 is approximately 12 inches.

Elongated member 413 has an enlarged first end 411 that is wider than the elongated member, and a second end 417 that is attached to arms 422*a* and 422*b*. As shown in FIG. 6, elongated member 413 has an end 502 forming the core of first end 411. Since one of the intended uses of anchor 410 is to anchor exercise device 400 between a door and jamb, it is preferable that the end 411 include materials that are soft enough to prevent damage to a wood door or door fame and sturdy enough to support the weight of a user. One embodiment that is soft and sturdy is shown in FIG. 6. Specifically, elongated member end 502 is partially surrounded by a recessed enclosure 505 and a pillow 507 that covers the elongated member end and the enclosure. Elongated member end 502 can further be held within end 411 by gluing and stitching the elongated member end to enclosure 505 and pillow 507, and by closing the pillow with one or more stitches 509. Elongated member 413 passes into first end 411 through a slot 504 in enclosure 505 and through slot 501 in pillow 507. In one embodiment, first end 411 is approximately 3.5" by 2.5" and is oriented approximately perpendicular to elongated member 413. In another embodiment, enclosure 505 is formed of a high-density, closed cell foam, and that pillow 507 is formed from a felt, and includes stitches 503. Alternatively, a second strap or piece of another material could be sewn, glued or otherwise attached to the end of elongated member 413 to form end 502. In another alternative embodiment, enclosure 505 can include another rigid member, such as a metal or hard plastic plate, to increase the rigidity of elongated member end 411.

Figure 7:
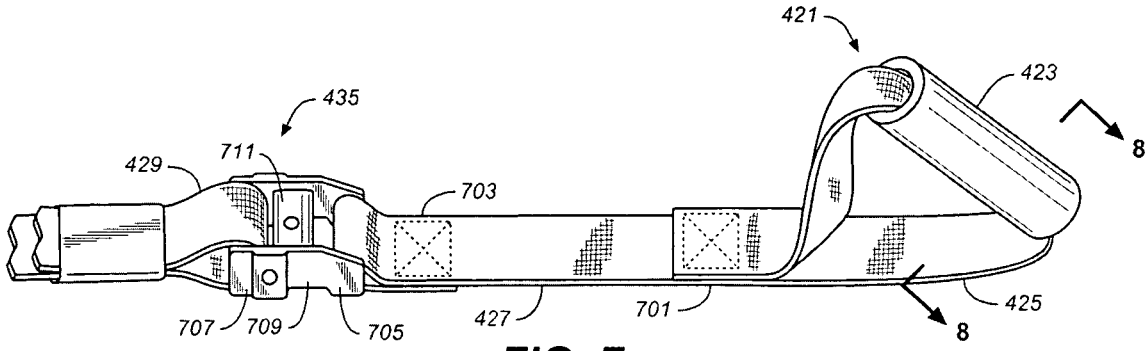
FIG. 7 is a perspective view showing details of the grip and the lengthening mechanism of the embodiment of FIG. 4.
Figure 9A:
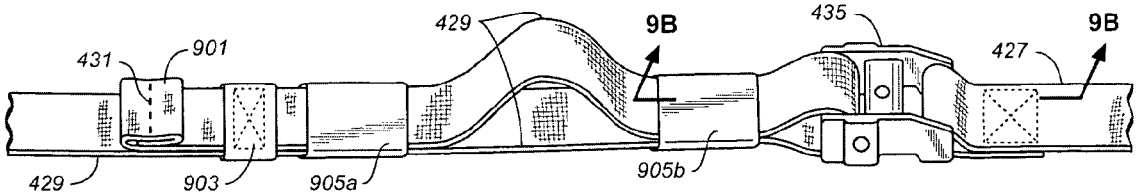
FIG. 9A is a perspective view showing details of the slack sleeves of the embodiment of FIG. 4.

Elongated members 422 are shown in greater detail in FIGS. 7, 8, 9A, and 9B, where FIG. 7 is a perspective view of one of the pair of grips 421 and the corresponding one of the pair of buckles 435, FIG. 8 is a sectional view 8-8 of one of the pair of grips 421, and FIG. 9A is a perspective view showing details of one of the pair of buckles and the adjoining strap 429.

Figure 9B:
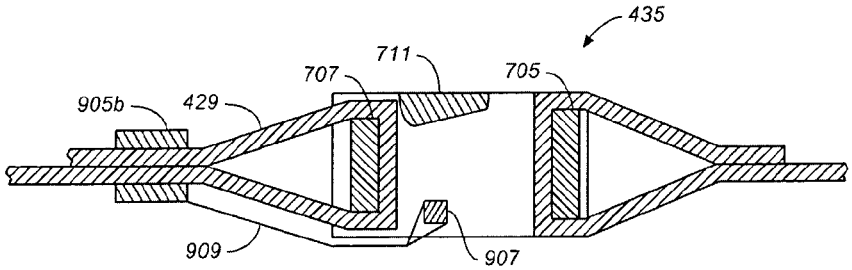
FIG. 9B is a sectional view 9B-9B of FIG. 9A showing details of the buckle and attachment of the slack sleeves to the buckle.

The details of one of the pair of ends 421, including strap 429 to grip 423, and including buckle 435 are shown in FIGS. 7, 9A and 9B. Buckle 435 is a cam buckle, the design and use of which are well known in the art. Buckle 435 is attached to strap 427, and thus the length of each of end 421 is not adjustable. Buckle 435 is also slidably accepts and grips strap 429, allowing for adjustment of the length L.

Buckle 435 has a frame 709, a first strap bar 705, a second strap bar 707, and a user movable cam 711. First strap bar 705 supports a loop of strap 427 that is preferably secured by stitches 703. Alternatively, strap 427 can be secured to bar 705 through a second member, such as another looped strap or a plastic or metal piece that loops about bar 705 and provides a location to attach strap 427. Strap 427 has an opposite end that is bound with stitches 701 to form loop 425 to secure grip 423, as described subsequently. Second strap bar 707 and cam 711 supports strap 429. It is to be understood that the use of stitches as described herein to fasten strap portions can also be accomplished through the use of other methods of fastening, such as glue or by melting strap portions together.

Cam 711 is spring loaded such that it normally restrains a strap 429, and that under the action of a user, such as by pushing or pulling the cam, the cam is moved to allow the strap to move. The distance between cam 711 and bar 707 is adjusted by the user and a spring within buckle 435 by pushing on cam 711, allowing strap 429 to slide between cam 711 and bar 707. Thus, each the length L can be adjusted by the user actuating cam 711 of buckle 435.

Grip 423 is shown in greater detail in the sectional view of FIG. 8. Grip 423 has a generally tubular shape, with an outer cover 801 and an inner cylindrical tubular portion 803. Cover 801 has a length and outer diameter to allow a hand to easily grab grip 423, and is formed from a material that permits a user to hold it while exercising. In one embodiment, the material for cover 801 is a high-density foam. Portion 803 provides the strength of grip 423 and can be formed from a length and diameter of plastic or other rigid material to match the size of cover 801 and to provide space for a loop 425 to pass through the center of portion 803. In one embodiment, portion 803 is formed from a rigid and light material, such as PVC tubing.

One of the pair of free ends 431 is shown in greater detail in FIG. 9A. Each end 431 is preferably folded back, and is held in place, for example by a stitch 901, to form an easily manipulated end. Elongated member 420 also includes several sleeves, shown as sleeves 903, 905*a* and 905*b* that twice surrounds strap 429 to prevent ends 431 from moving about. Specifically, sleeves 903 and 905 are placed between buckles 435, ends 431 and strap 429. Thus sleeves 903 and 905 restrain the portion of strap 429 from a buckle 435 to the corresponding end 431 from moving about as exercise device 420 is moved. As shown in FIG. 9A, sleeve 903 is affixed near end 431, while sleeves 905 can be slid along the length of strap 429. FIG. 9B is a sectional view 9B-9B of FIG. 9A showing details of the cam buckle and attachment of sleeve 905*b*. In particular, FIG. 9B shows a bar 907 that spans buckle 435 and a strap 909 that is attached both the bar and to sleeve 905*b*. Strap 909 keeps sleeve 905*b* from sliding too far down strap 429 during adjustment of the length of the exercise device. It is preferred that sleeves 905*b* are elastic so that they can easily move and hold together the portions of strap 429.

Figure 10:
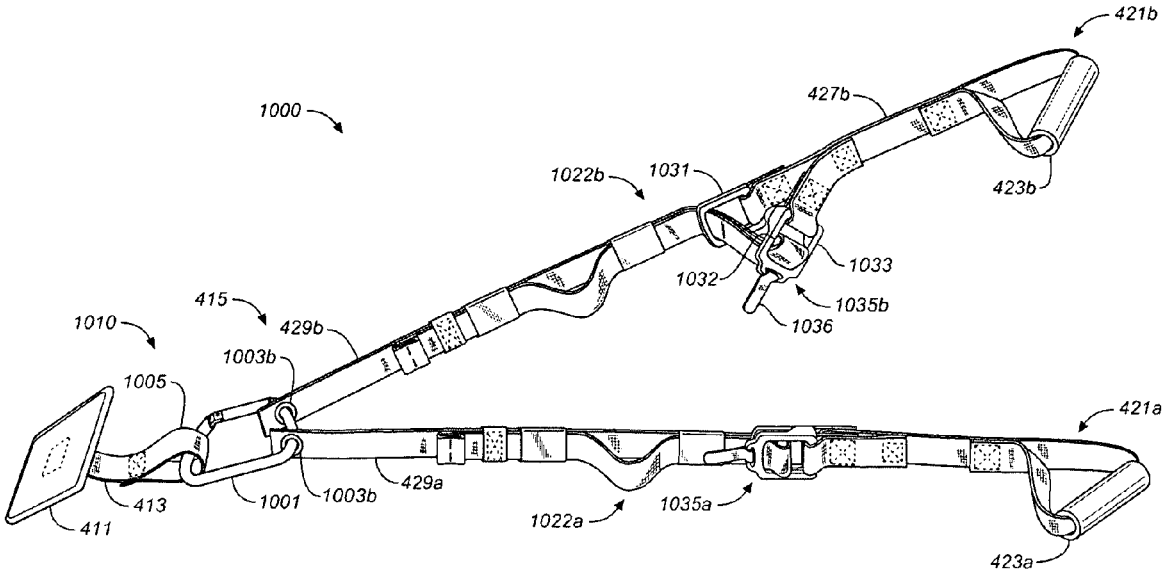
FIG. 10 is a perspective view of a third embodiment of an exercise device.

FIG. 10 is a perspective view of a third exercise device 1000 is shown as including a first embodiment of an anchor 1010 and a pair of elongated members 1022. Exercise device 1000, anchor 1010, and elongated members 1022 are generally similar to exercise devices 100 and 400, anchors 110 and 410, and elongated members 122 and 422 respectively, except further detailed below. Specifically, exercise device 1000 is similar to exercise device 400, and provides the added advantage of having easily replaceable elongated members 1022. Where possible, similar elements are identified with identical reference numerals in the Figures.

Each elongated member 1022 includes a buckle 1035, shown as buckle 1035*a* and 1035*b*. As shown in detail with respect to buckle 1035*a*, buckle 1035 includes a first ring 1031 and a second ring 1033 having a center bar 1032 and a tab 1036. Strap 427 is attached to both ring 1031 and 1033, and strap 429 passes through ring 1031, around bar 1032, and back through ring 1031. Buckle 1035*a* illustrates the buckle restraining straps 429 and 427. When tab 1032 is pulled to separate rings 1031 and 1033, as shown for buckle 1035*b*, the length of elongated member 1022 may be changed. Each strap 429 also includes a reinforced hole 1003, indicated as hole 1003*a* and 1003*b*.

Anchor 1010 includes inelastic, flexible elongated member 413, enlarged first end 411, a loop 1005, and a ring 1001. In one embodiment, ring 1001 is a gated ring, such as a carabineer, or a snap ring. Ring 1001 passes through holes 1003*a* and 1003*b*, thus supporting elongated members 1022*a* and 1022*b*, respectively. Holes 1003*a* and 1003*b* and ring 1001 form attachment 415.

Figure 12:
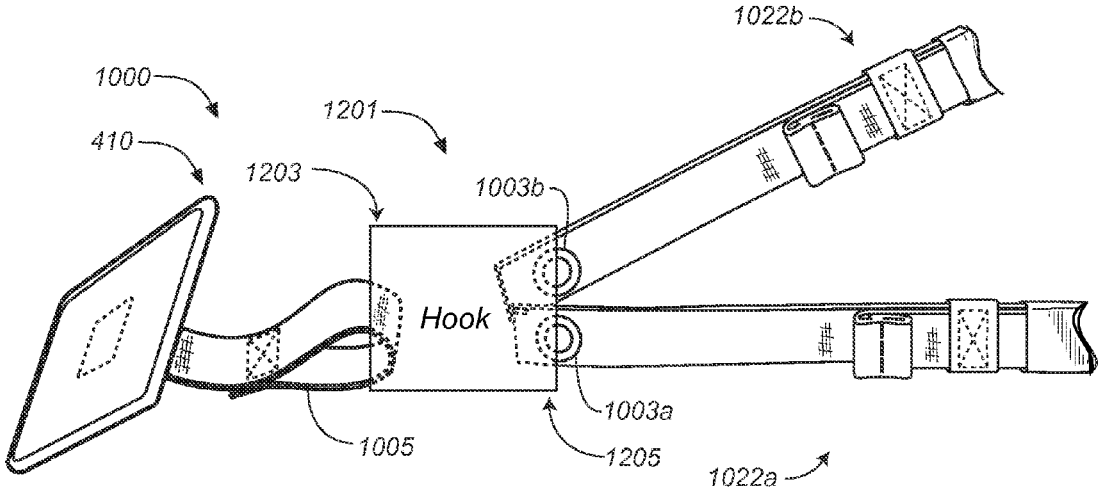
FIG. 12 is a perspective view of a fourth embodiment of an anchor.

An alternative embodiment of exercise device 1000 is shown in a perspective view FIG. 12, where ring 1001 of FIG. 10 is replaced with a hook, shown schematically as hook 1201. FIG. 12 illustrates hook 1201 as having a first hook portion 1203 connectable to loop 1005 and a second portion 1205 connectable to holes 1003*a* and 1003*b* of elongated members 1022*a* and 1022*b*, respectively.

While exercise device 100, and more specifically exercise device 400, has been described with respect to a particular embodiment, there are many alternative embodiments. Thus, for example, the elongated members could be round instead of the straps illustrated in the figures. In addition, the grips illustrated on devices 100, 400 and 1000 may be replaced with foot grips, finger grips, combination grips, or accessory grips, as described, for example in U.S. patent application Ser. No. 11/557,050, filed Dec. 6, 2006, incorporated herein by reference.

Methods of Exercising

The inventive exercise device allows for a wide range of exercises. Examples of the many exercises that are possible are presented in TABLE 1 for the inventive device placed over the top of a door. FIGS. 3 and 11 illustrate three of the many exercise positions. In each of these positions the user has positioned himself on the ground a desired horizontal distance X from anchor point A with a portion of his weight being supported by the exercise device. With his weight so supported, as shown in FIGS. 3 and 11, he moves his body in directions appropriate to the type of exercise to be performed, for example by moving his body toward or away from the wall or ground, by bending his arms or legs while supporting his weight by the exercise device, or performing other movements that exercise his muscles.

TABLE 1

Several Basic, Intermediate, and Advanced Over the Door Anchor Exercises

| Basic Exercises | Intermediate | Advanced |
|---|---|---|
| Pull functions | Pull functions | Pull/lateral functions |
| Low row | One-arm low row | Lateral raise |
| High row | One-arm high row | Front shoulder raise |
| Pull-up | One-arm pull-up | Reverse-grip curl |
| High curl | One-arm high curl | Combination row/kickback |
| Low curl | One-arm low curl | Internal rotator cuff |
| Back fly | Lower chest/lat crunch | External rotator cuff |
| Wrist curl | Reverse-grip wrist curl | 2-Way forearm flexors |
| Core Strength | Core Strength | Core Strength |
| Crunch | Kneeling combination crunch | Standing combination crunch |
| Reverse single leg raise | Reverse leg raise | Reverse leg raise w/ hip lift |
| Oblique crunch | V-sit-up | Reverse oblique raise |
| Reverse crunch | Hip lift | V-balance |
| Bicycle | Reverse bicycle | Reverse combination crunch |
| Back Bridge | | |
| Legs | Legs | Legs |
| Squat | Lying hamstring pedal | Lying hamstring curl |
| Hip hinge | Tip-toe squat | Single-leg hip hinge |

TABLE 1-continued

| Several Basic, Intermediate, and Advanced Over the Door Anchor Exercises | | |
|---|---|---|
| Basic Exercises | Intermediate | Advanced |
| Squat lunge | Step-back lunge | Single leg L-squat |
| Sumo squat | Single leg squat | Diagonal Step-back lunge |
| Side-to-side lunge | Single calf raise | Crossover off-balance squat |
| Calf raise | Jumping Ski PT | |
| Push functions | Push functions | Push functions |
| Standard press | One-arm incline press | Triceps kickback |
| Chest fly | Low chest press (outside grip) | One-arm concentration fly |
| Shoulder press | Reverse Push-up | Reverse crunch/push-up combo |
| Overhead triceps extension | One-arm triceps extension | One-arm shoulder press |
| Lat-Pullovers | | Gymnast dip |

Figure 11A:
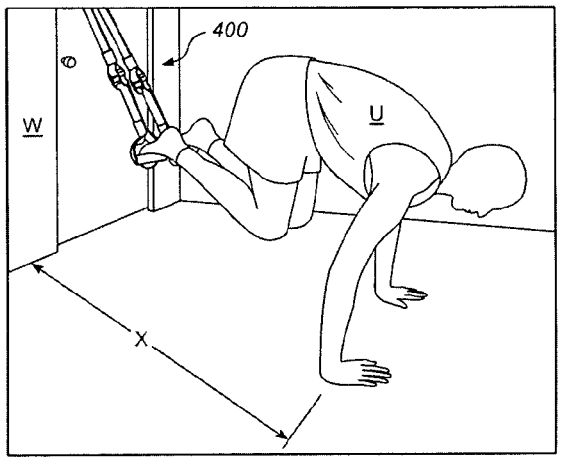
FIGS. 11A-11I illustrate poses of a user using an embodiment of an exercise device to perform exercises, where
Figure 11B:
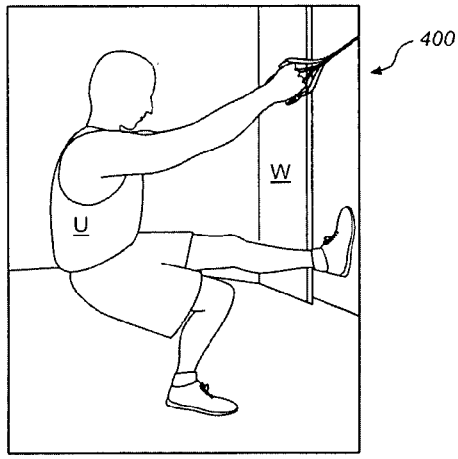
Figure 11C:
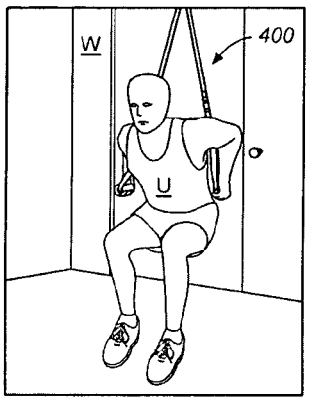
Figure 11E:
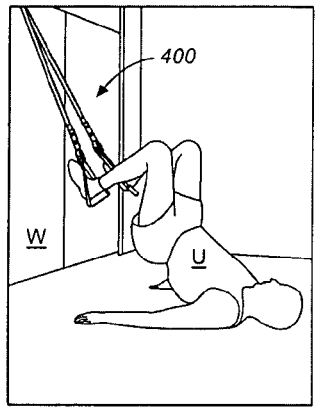
Figure 11D:
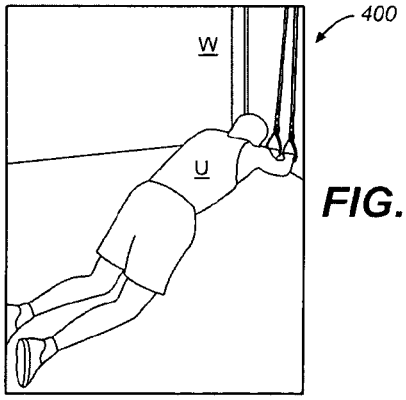
Figure 11F:
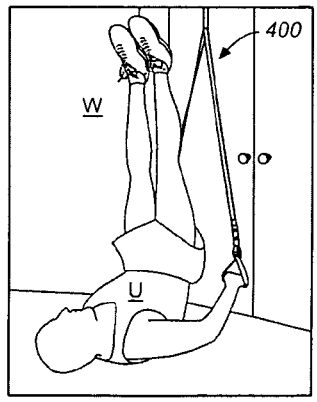
Figure 11G:
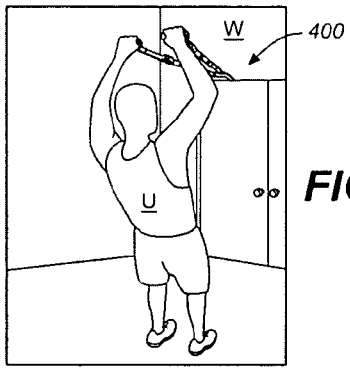
Figure 11H:
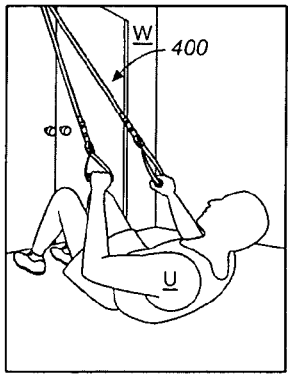
Figure 11I:
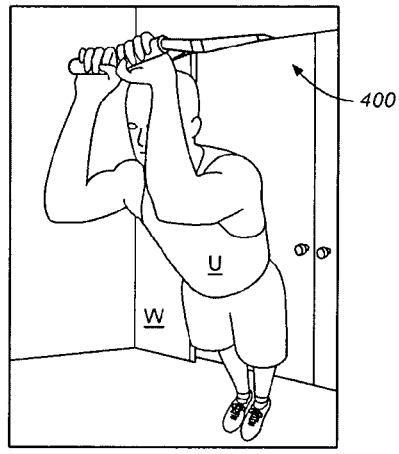

Specifically illustrated in FIGS. 3 and 11 are single poses of a user U performing a variety of exercises including a high row exercise (FIG. 3), a reverse combination crunch (FIG. 11A), a single leg L-squat (FIG. 11B), a gymnast dip (FIG. 11C), a kneeling combination crunch (FIG. 11D), a lying leg curl (FIG. 11E), a hip lift (FIG. 11F), a front shoulder raise (FIG. 11G), a crunch (FIG. 11H), and a triceps extension (FIG. 11I). It is apparent from FIGS. 3 and 11 that many different types of exercises are possible with the inventive exercise device according to the length of the device, the positioning of the body, and how the handles are gripped. In addition, the inventive device can be used to perform one handed exercises.

Although the invention(s) presented herein have been disclosed in the context of certain preferred embodiments and examples, it will be understood by those skilled in the art that the invention(s) extend beyond the specifically disclosed embodiments to other alternative embodiments and/or uses of the invention(s) and obvious modifications and equivalents thereof. Thus, it is intended that the scope of the invention(s) herein disclosed should not be limited by the particular embodiments described above, but should be determined only by a fair reading of the claims that follow.

What is claimed is:

1. An exercise device for mounting between a door and a door jamb of a closed door, said exercise device comprising:

an anchor having a first portion, an enlarged portion, and an elongate portion that extends between said first portion and said enlarged portion, and a pair of portions, where each of the pair of portions is inelastic and has a length that extends from a corresponding grip to an end, and where each of said ends is fixedly connected to said first portion, where, when said anchor is mounted to the closed door:

said elongated portion extends from a first side of the closed door to a second side of the closed door, said enlarged portion is not passable through the closed door, and said first portion extends away from the second side of said door by a distance.

2. The exercise device of claim 1, where the distance is greater than 1 inch.

3. The exercise device of claim 1, where the distance is greater than 2 inches.

4. The exercise device of claim 1, where the distance is greater than 4 inches.

5. The exercise device of claim 1, where the distance is greater than 6 inches.

6. The exercise device of claim 1, where the distance is between 1 inch and 18 inches.

7. The exercise device of claim 1, where the length between said grip and said end of each of the pair of portions is independently adjustable.

8. The exercise device of claim 1, where the length between said anchor and each grip is adjustable.

* * * * *